US010677268B2

(12) United States Patent
Itou et al.

(10) Patent No.: US 10,677,268 B2
(45) Date of Patent: Jun. 9, 2020

(54) CONSTRUCTION MACHINE

(71) Applicant: Hitachi Construction Machinery Co., Ltd., Taito-ku, Tokyo (JP)

(72) Inventors: Daiki Itou, Chiba (JP); Akihiro Narazaki, Ibaraki (JP); Katsuaki Kodaka, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/329,032

(22) PCT Filed: Feb. 20, 2018

(86) PCT No.: PCT/JP2018/006055
§ 371 (c)(1),
(2) Date: Feb. 27, 2019

(87) PCT Pub. No.: WO2018/151323
PCT Pub. Date: Aug. 23, 2018

(65) Prior Publication Data

US 2019/0219071 A1 Jul. 18, 2019

(30) Foreign Application Priority Data

Feb. 20, 2017 (JP) ..... 2017-029305

(51) Int. Cl.
*F15B 11/08* (2006.01)
*E02F 9/22* (2006.01)
*E02F 9/20* (2006.01)

(52) U.S. Cl.
CPC ..... *F15B 11/08* (2013.01); *E02F 9/20* (2013.01); *E02F 9/22* (2013.01);
(Continued)

(58) Field of Classification Search
CPC ..... F15B 2211/6316; F15B 2211/575; F15B 2211/355; F15B 2211/36; F15B 2211/6346; E02F 9/2285
See application file for complete search history.

(56) References Cited

U.S. PATENT DOCUMENTS 8,812,202 B2 * 8/2014 Yamamoto ..... E02F 9/128 701/54
9,020,708 B2 * 4/2015 Yamamoto ..... E02F 9/123 701/50

(Continued)

FOREIGN PATENT DOCUMENTS

JP 8-189502 A 7/1996
JP 2014-65324 A 4/2014

OTHER PUBLICATIONS

International Search Report (PCT/ISA/210) issued in PCT Application No. PCT/JP2018/006055 dated May 1, 2018 with English translation (three (3) pages).

(Continued)

*Primary Examiner* — Thomas E Lazo
(74) *Attorney, Agent, or Firm* — Crowell & Moring LLP

(57) ABSTRACT

In a construction machine with a hydraulic pilot type hydraulic control device, occurrence of jerking is prevented. A hydraulic excavator 1 having hydraulic pumps 51L and 51R, travel motors 22L and 22R, traveling operating levers 34L and 34R, a pilot pump 54, hydraulic pilot valves 55La, 55Lb, 55Ra, and 55Rb, and directional control valves 53L and 53R includes: changeover switches 35L and 35R which change the operating mode of the traveling operating levers 34L and 34R; pilot pressure adjusting devices 5L and 5R which adjust the pilot pressure applied to the directional control valves 53L and 53R; and pilot pressure sensors 56La, 56Lb, 56Ra, and 56Rb. The pilot pressure adjusting devices apply the pilot pressure at the time when the operating mode (Continued)

of the traveling operating levers 34L and 34R is changed to a control mode, to the directional control valves 53L and 53R.

4 Claims, 9 Drawing Sheets

(52) U.S. Cl.
CPC ..... *F15B 2211/20576* (2013.01); *F15B 2211/329* (2013.01); *F15B 2211/6355* (2013.01)

(56) References Cited

U.S. PATENT DOCUMENTS 10,006,472 B2 * 6/2018 Nishikawa ..... E02F 9/123
10,344,458 B2 * 7/2019 Hijikata ..... F15B 19/005
10,526,768 B2 * 1/2020 Hijikata ..... E02F 9/268

OTHER PUBLICATIONS

Japanese-language Written Opinion (PCT/ISA/237) issued in PCT Application No. PCT/JP2018/006055 dated May 1, 2018 (four (4) pages).

* cited by examiner

CONSTRUCTION MACHINE

TECHNICAL FIELD

The present invention relates to a construction machine.

BACKGROUND ART

Generally, in a construction machine such as a hydraulic excavator, a pilot pressure (oil pressure signal) depending on the operation amount of an operating lever is generated by operation of a mechanical operating lever by the operator. By applying this pilot pressure to a directional control valve, a hydraulic actuator is driven. The method which drives the directional control valve by an oil pressure signal is called "hydraulic pilot type".

A construction machine is often operated while traveling on a rough road and particularly when passing an obstacle on the road surface, the vehicle body vibrates. At this time, the operator is swung due to vibration of the vehicle body and thus it is difficult to hold the operating lever in a given position, which may cause erroneous operation of the operating lever. Accordingly, the pilot pressure may vary largely and cause jerking.

As a technique for output of a stable operation signal, for example, PTL 1 proposes a method which controls the travel of a vehicle body by processing an electrical pilot type signal waveform. Specifically, the frequency of an electrical operation signal to operate the travel of the vehicle body is attenuated by a band elimination filter process and then the peak frequency is cut by a low-pass filter process to smoothen the operation signal waveform.

CITATION LIST

Patent Literature

PATENT LITERATURE 1: Japanese Patent Application Laid-Open No. 2014-65324

SUMMARY OF INVENTION

Technical Problem

A possible method for stabilizing operation of the mechanical operating lever is, for example, to change the spring constant of the mechanical operating lever to lower the operability of the lever to prevent erroneous operation of the lever due to vibration of the vehicle body and suppress the occurrence of jerking. However, in this method, even in a normal condition in which no jerking occurs, operation of the lever is less easy and the operability of the lever is low. In addition, the technique described in PTL 1 concerns an electrical pilot type operation signal and thus the technique described in PTL 1 cannot be applied directly to the above hydraulic pilot type construction machine.

Therefore, an object of the present invention is to suppress occurrence of jerking in a construction machine with a hydraulic pilot type hydraulic control device.

Solution to Problem

In order to achieve the above object, there is provided a construction machine which has a hydraulic pump, a hydraulic actuator driven by pressure oil supplied from the hydraulic pump, an operating device to operate the hydraulic actuator, a pilot pump, a hydraulic pilot valve to generate a pilot pressure as an oil pressure signal depending on operation amount of the operating device from the pressure oil supplied from the pilot pump, and a directional control valve driven by the pilot pressure from the hydraulic pilot valve to control a flow of the pressure oil supplied to the hydraulic actuator. The machine includes: a changeover device which changes an operating mode of the operating device to a normal mode or a control mode selectively; a pilot pressure adjusting device which adjusts the pilot pressure applied to the directional control valve; and a pilot pressure sensor which detects the pilot pressure. In a case where the operating mode of the operating device is changed to the control mode by operation of the changeover device, the pilot pressure adjusting device reduces the pilot pressure detected by the pilot pressure sensor at time of change to the control mode to a preset target pilot pressure and applies the pilot pressure as an operation signal to the directional control valve.

Advantageous Effects of Invention

According to the present invention, occurrence of jerking can be prevented by oil pressure signal processing. Other and further objects, features, and advantages will appear more fully from the following description of an embodiment.

DESCRIPTION OF EMBODIMENT

Next, as a mode of the construction machine according to an embodiment of the present invention, a crawler type hydraulic excavator will be described.

<General Structure of Hydraulic Excavator 1>

First, the general structure of a hydraulic excavator 1 will be described referring to FIG. 1.

Figure 1:
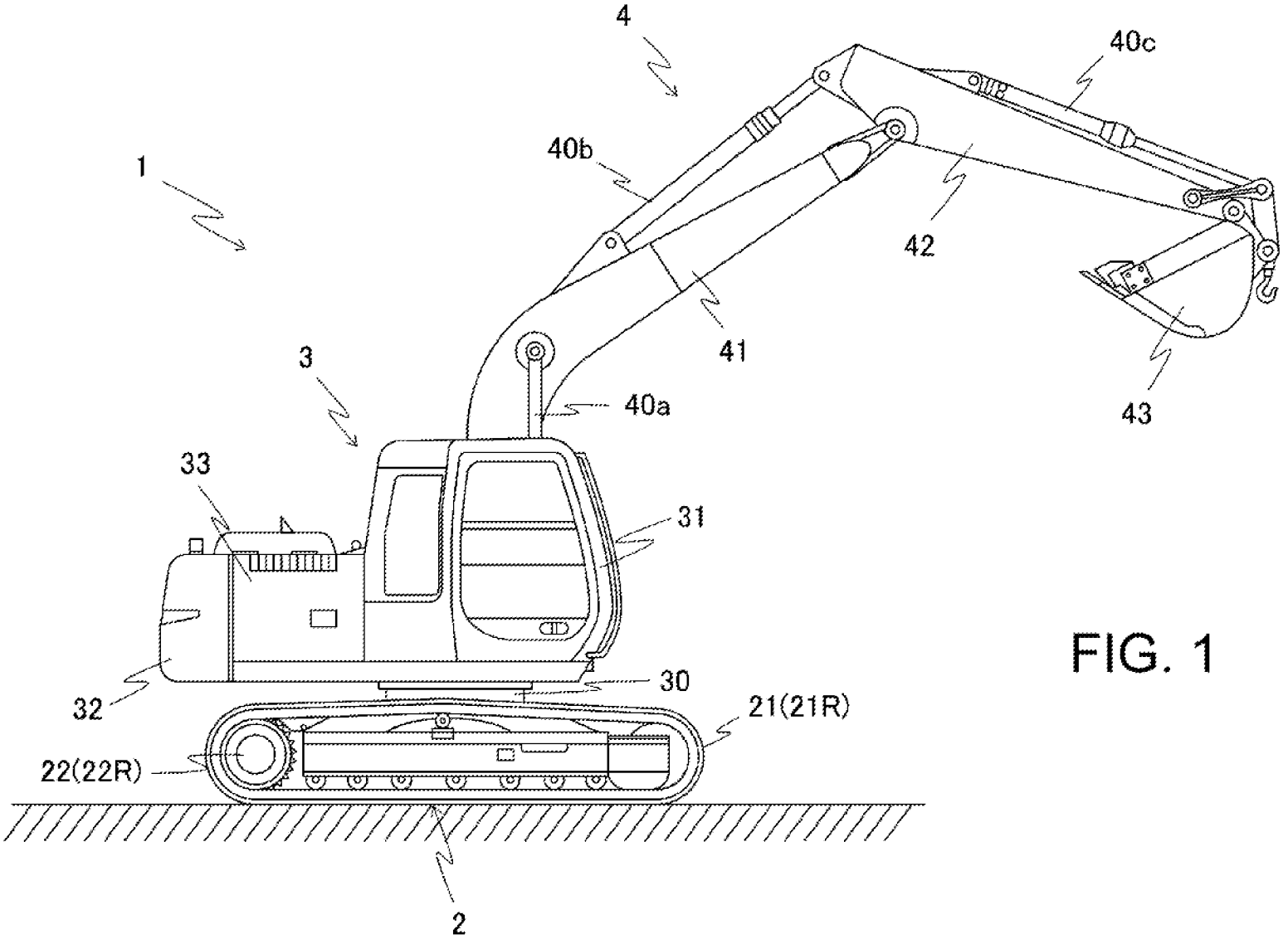
FIG. 1 is an external view which shows an example of the structure of a hydraulic excavator according to an embodiment of the present invention.

FIG. 1 is an external view which shows an example of the structure of the hydraulic excavator 1 according to the embodiment.

The hydraulic excavator 1 includes: an undercarriage 2 for traveling on a road surface; an upperstructure 3 attached swingably over the undercarriage 2 through a swing device 30; and a front working device 4 attached in front of the upperstructure 3 to perform work such as excavation.

The undercarriage 2 includes a crawler 21 and a travel motor 22 to rotate the crawler 21, and the driving power of the travel motor 22 rotates the crawler 21 held in contact with the road surface to move the vehicle body.

The crawler 21 is provided on each of the left and right of the vehicle body and the travel motor 22 is also provided on each of the left and right of the vehicle body in a manner to correspond to each of the left and right crawlers 21. The operator can rotate the left and right crawlers 21 in the normal and reverse directions independently by driving the left and right travel motors 22 independently by operation of traveling operating levers 34L and 34R (see FIG. 2) which will be described later. In FIG. 1, among the left and right crawlers 21 and the left and right travel motors 22, the right crawler 21R and right travel motor 22R are shown.

The upperstructure 3 includes: a cab 31 located on the front of the vehicle body, in which the operator boards; a counter weight 32 located on the back of the vehicle body to keep balance to prevent tilting of the vehicle body; and a machine chamber 33 located between the cab 31 and counter weight 32 to house an engine and the like. The upperstructure 3 is swung by the driving power of a swing motor (not shown) housed in the swing device 30.

The front working device 4 includes: a boom 41 which has a base end rotatably attached to the upperstructure 3 and is rotated vertically with respect to the vehicle body; an arm 42 which is rotatably attached to the tip of the boom 41 and rotated vertically with respect to the vehicle body; and a bucket 43 which is rotatably attached to the tip of the arm 42 and rotated vertically with respect to the vehicle body.

The bucket 43 can be replaced by an attachment, for example, a breaker for excavating rocks or a secondary crusher for crushing rocks. Consequently, the hydraulic excavator 1 can carry out various types of work including excavation and crushing, using an attachment suitable for the type of work.

The front working device 4 further includes: a boom cylinder 40*a* which connects the upperstructure 3 and the boom 41 and extends and shrinks to rotate the boom 41; an arm cylinder 40*b* which connects the boom 41 and the arm 42 and extends and shrinks to rotate the arm 42; a bucket cylinder 40*c* which connects the arm 42 and the bucket 43 and extends and shrinks to rotate the bucket 43; and a plurality of pipes (not shown) which lead hydraulic oil into these cylinders 40*a*, 40*b*, and 40*c*.

Figure 2:
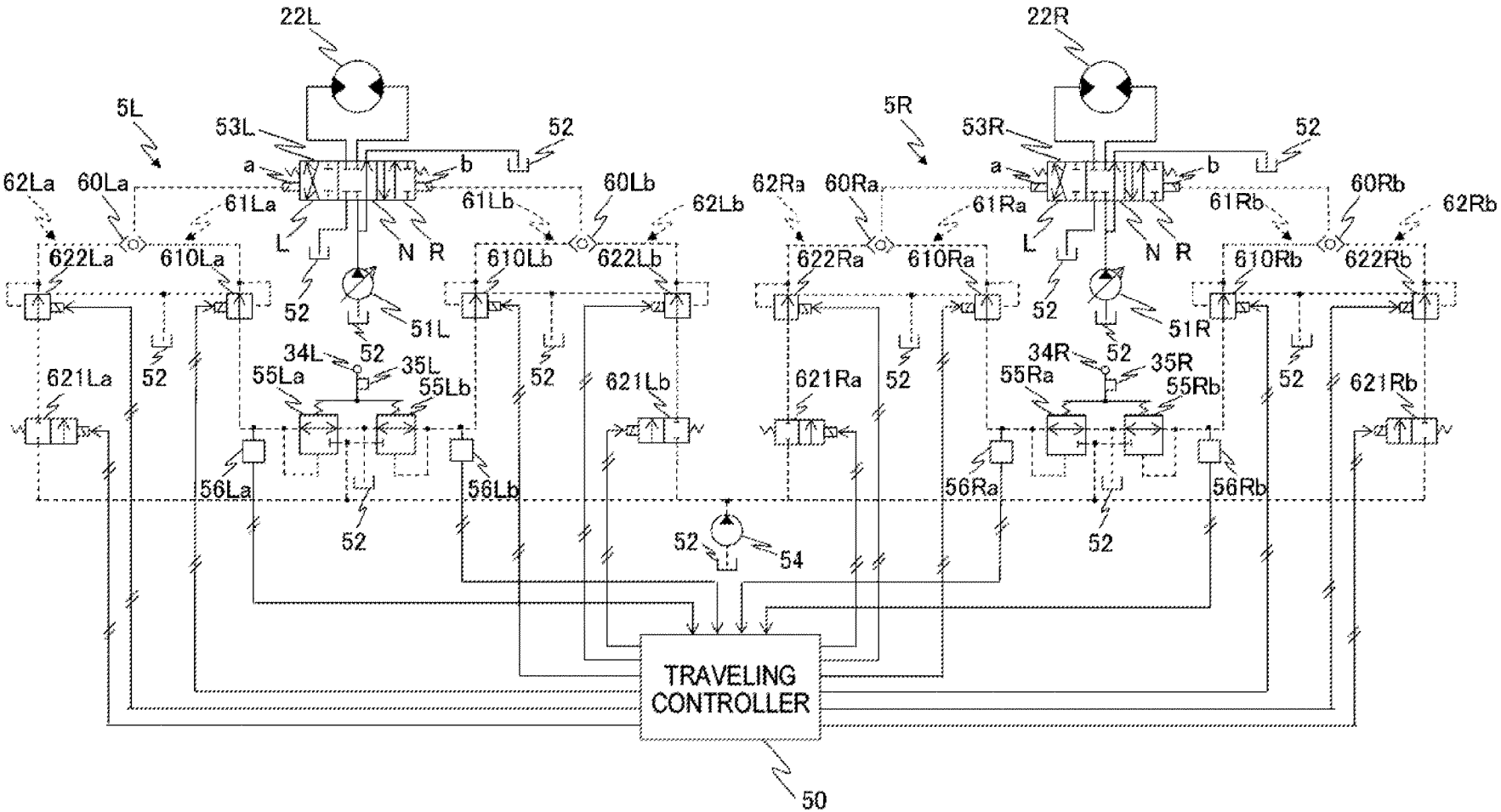
FIG. 2 is a diagram which shows an example of the structure of a traveling hydraulic control system.

The travel motor 22 and swing motor and the boom cylinder 40*a*, arm cylinder 40*b*, and bucket cylinder 40*c* are a kind of hydraulic actuators which are driven by pressure oil supplied from hydraulic pumps 51L and 51R (see FIG. 2). These hydraulic actuators are driven under the control by a hydraulic control system including a hydraulic circuit and a controller. Next, a traveling hydraulic control system which controls the drive of the travel motors 22 (22L, 22R) will be described in detail.

<Structure of the Traveling Hydraulic Control System>

Next, the structure of the traveling hydraulic control system will be described referring to FIG. 2.

FIG. 2 is a diagram which shows an example of the structure of the traveling hydraulic control system. In the traveling hydraulic control system, the left and right travel motors 22L and 22R have the same structure, so an explanation is given below taking the traveling hydraulic control system relating to the left travel motor 22L for example and detailed explanation of the traveling hydraulic control system relating to the right travel motor 22R is omitted. By replacing L in the reference sign of each element by R in the explanation of the traveling hydraulic control system relating to the left travel motor 22L, the explanation becomes an explanation of the traveling hydraulic control system relating to the right travel motor 22R.

The traveling hydraulic control system includes: a hydraulic pump 51L; a hydraulic oil tank 52 for storing the hydraulic oil to be sucked into the hydraulic pump 51; a travel motor 22L driven by pressure oil supplied from the hydraulic pump 51L; a directional control valve 53L for controlling the flow (flow rate and direction) of pressure oil supplied to the travel motor 22L; a pilot pump 54; a traveling operating lever 34L as an operating device for operating the travel motor 22L; and a pair of hydraulic pilot valves 55La and 55Lb which generate a pilot pressure as an oil pressure signal depending on the operation of the traveling operating lever 34L, from the pressure oil supplied from the pilot pump 54.

The hydraulic pump 51L sucks hydraulic oil from the hydraulic oil tank 52 and supplies it to the travel motor 22L and the pilot pump 54 sucks hydraulic oil from the hydraulic oil tank 52 and supplies it to the directional control valve 53L.

The directional control valve 53L has a first switching position R to cause normal rotation of the travel motor 22L, a second switching position N to send the pressure oil back to the hydraulic oil tank 52 directly, and a third switching position L to cause reverse rotation of the travel motor 22L (open center type).

The directional control valve 53L is structured so as to be switched to one of the first to third switching positions R, N, and L when the inner spool moves left and right reciprocally according to the pilot pressures applied to the left and right pressure receiving chambers a and b. When it is in the first switching position R and third switching position L, the pressure oil led by the travel motor 22L flows out to the hydraulic oil tank 52.

The pair of hydraulic pilot valves 55La and 55Lb each generate a pilot pressure depending on the operation amount of the traveling operating lever 34L. In FIG. 2, in a case where the operator operates the traveling operating lever 34L to tilt it left (actually forward), the left hydraulic pilot valve 55La is driven to reduce the delivery pressure from the pilot pump 54 to a pressure depending on the operation amount of the traveling operating lever 34L. Consequently, a pilot pressure to be applied to the left pressure receiving chamber a of the directional control valve 53L is generated.

Also, in a case where the operator operates the traveling operating lever 34L to tilt it right (actually rearward), the right hydraulic pilot valve 55Lb is driven to reduce the delivery pressure from the pilot pump 54 to a pressure depending on the operation amount of the traveling operating lever 34L. Consequently, a pilot pressure to be applied to the right pressure receiving chamber b of the directional control valve 53L is generated. Therefore, the pilot pressures generated by the pair of hydraulic pilot valves 55La and 55Lb are each lower than the delivery pressure from the pilot pump 54.

In addition, the traveling hydraulic control system according to this embodiment includes: a changeover switch 35L as a changeover device which changes the operating mode of the traveling operating lever 34L to the "normal mode" or "control mode" selectively; a pair of pilot pressure sensors 56La and 56Lb which detect the pilot pressures generated by the pair of hydraulic pilot valves 55La and 55LB respectively; and a pilot pressure adjusting device 5L which adjusts the pilot pressure applied to the directional control valve 53L according to the operation of the changeover switch 35L.

As for the operating modes of the traveling operating lever 34L, the "control mode" is an operating mode which is used in order to prevent occurrence of jerking due to erroneous operation of the traveling operating lever 34L by the operator or suppress amplification of jerking, for example, during traveling on a rough road, and the "normal mode" is an operating mode which is used in a case where suppression of jerking is not particularly necessary, for example, during normal operation of the hydraulic excavator 1 or the like. In this embodiment, when the operator holds the changeover switch 35L depressed, it is the "control mode" and when the operator releases his/her finger from the changeover switch 35L, it is the "normal mode".

In FIG. 2, of the pair of pilot pressure sensors 56La and 56Lb, the left pilot pressure sensor 56La detects the pilot pressure generated by the left hydraulic pilot valve 55La and the right pilot pressure sensor 56Lb detects the pilot pressure generated by the right hydraulic pilot valve 55Lb. Therefore, the left pilot pressure sensor 56La is located more downstream than the left hydraulic pilot valve 55La with respect to the flow of pressure oil and the right pilot pressure sensor 56Lb is located more downstream than the right hydraulic pilot valve 55Lb with respect to the flow of pressure oil.

In the pilot pressure adjusting device 5L, the structure to adjust the pilot pressure applied to the left pressure receiving chamber a of the directional control valve 53L and the structure to adjust the pilot pressure applied to the right pressure receiving chamber b of the directional control valve 53L are the same, so an explanation is given below taking the structure to adjust the pilot pressure applied to the left pressure receiving chamber a of the directional control valve 53L for example and detailed explanation of the structure to adjust the pilot pressure applied to the right pressure receiving chamber b of the directional control valve 53L is omitted.

The pilot pressure adjusting device 5L includes a pilot line 61La, a bypass line 62La, a first solenoid pressure reducing valve 610La provided in the pilot line 61La, an solenoid on-off valve 621La and a second solenoid pressure reducing valve 622La which are provided in the bypass line 62La, and a traveling controller 50 which sends a drive signal to each of the first solenoid pressure reducing valve 610La, solenoid on-off valve 621La and second solenoid pressure reducing valve 622La.

The pilot line 61La is a line to connect the hydraulic pilot valve 55La and the directional control valve 53L and apply the pilot pressure generated by the hydraulic pilot valve 55La to the directional control valve 53L (left pressure receiving chamber a).

In the pilot line 61La, the first solenoid pressure reducing valve 610La is located more downstream than the pilot pressure sensor 56La and more upstream than the directional control valve 53L with respect to the flow of pressure oil. The opening of the first solenoid pressure reducing valve 610La is adjusted according to the drive signal sent from the traveling controller 50.

The bypass line 62La is a line to connect the pilot pump 54 and directional control valve 53L by bypassing the hydraulic pilot valve 55La and apply the delivery pressure (pilot pressure) from the pilot pump 54 to the directional control valve 53L (left pressure receiving chamber a) directly.

In the bypass line 62La, the solenoid on-off valve 621La and the second solenoid pressure reducing valve 622La are located downstream of the pilot pump 54 and upstream of the directional control valve 53L with respect to the flow of pressure oil. In this embodiment, in the bypass line 62La, the solenoid on-off valve 621La is located upstream of the second solenoid pressure reducing valve 622La with respect to the flow of pressure oil.

The solenoid on-off valve 621La receives a drive signal from the traveling controller 50 and makes the bypass line 62La open. The opening of the second solenoid pressure reducing valve 622La is adjusted according to the drive signal sent from the traveling controller 50 so that the delivery pressure from the pilot pump 54 is reduced to a prescribed target pilot pressure.

In this embodiment, the pilot line 61La and bypass line 62La converge through a check valve 60La on the more downstream side with respect to the flow of pressure oil than the first solenoid pressure reducing valve 610La and second solenoid pressure reducing valve 622La. The check valve 60La prevents each of the pressure oil flowing in the pilot line 61La and the pressure oil flowing in the bypass line 62La from flowing back to the other line.

Specifically, in a case where the solenoid on-off valve 621La is driven upon receipt of a drive signal from the traveling controller 50 and the bypass line 62La becomes open, pressure oil flows in both the pilot line 61La and bypass line 62La. At this time, the check valve 60La functions so as to guide the pressure oil flowing in the pilot line 61La or the pressure oil flowing in the bypass line 62La, whichever has the higher pressure, to the directional control valve 53L.

The traveling controller 50 receives a signal from the changeover switch 35L and pilot pressure sensor 56La and internally makes a calculation, etc. to adjust the pilot pressure, and then sends a drive signal to each of the first solenoid pressure reducing valve 610La, solenoid on-off valve 621La, and second solenoid pressure reducing valve 622La.

Specifically, the traveling controller 50 includes: a CPU (Central Processing Unit) which makes various calculations, etc. to control the pilot pressure applied to the directional control valve 53L; a storage medium to store a program for the CPU to make calculations, etc. such as a ROM (Read Only Memory) or HDD (Hard Disk Drive); a RAM (Random Access Memory) as a working area for execution of the program by the CPU; and an I/F (interface) which performs input/output of a signal for the devices provided in the pilot line 61La and bypass line 62La.

The CPU, ROM, HDD, RAM, and I/F are electrically connected to each other via a bus and the devices provided in the pilot line 61La and bypass line 62La are electrically connected to the I/F.

In this hardware configuration, the CPU reads the travel control program stored in the storage medium such as a ROM or HDD, expands it on the RAM and executes the expanded travel control program (software) so that the function as the travel control system is performed by cooperation of the travel control program (software) and the hardware.

In this embodiment, the structure of the traveling controller 50 has been explained as a combination of software and hardware, but it is not limited to this; for example, an integrated circuit which performs the function of the travel control program may be used for it.

The structure which adjusts the pilot pressure applied to the left pressure receiving chamber a of the directional control valve 53L in the pilot pressure adjusting device 5L has been concretely described above. Similarly, the structure which adjusts the pilot pressure applied to the right pressure receiving chamber b of the directional control valve 53L also includes a pilot line 61Lb, bypass line 62Lb, first solenoid pressure reducing valve 610Lb, solenoid on-off valve 621Lb, second solenoid pressure reducing valve 622Lb, and traveling controller 50.

Like the traveling hydraulic control system relating to the left travel motor 22L, the traveling hydraulic control system relating to the right travel motor 22R includes a hydraulic pump 51R, hydraulic oil tank 52, travel motor 22R, directional control valve 53R, pilot pump 54, traveling operating lever 34R, a pair of hydraulic pilot valves 55Ra and 55Rb, changeover switch 35R, a pair of pilot pressure sensors 56Ra and 56Rb, and a pilot pressure adjusting device 5R.

As in the case of the traveling hydraulic control system relating to the left travel motor 22L, the pilot pressure adjusting device 5R in the traveling hydraulic control system relating to the right travel motor 22R includes pilot lines 61Ra and 61Rb, bypass lines 62Ra and 62Rb, first solenoid pressure reducing valves 610Ra and 610Rb, solenoid on-off valves 621Ra and 621Rb, second solenoid pressure reducing valves 622Ra and 622Rb, and traveling controller 50. The traveling controller 50, hydraulic oil tank 52, and pilot pump 54 are shared by the left and right traveling hydraulic control systems.

<Method for Adjusting the Pilot Pressure Applied to the Directional Control Valve 53L>

Next, the method for adjusting the pilot pressure applied to the directional control valve 53L will be described referring to FIG. 3.

Figure 3:
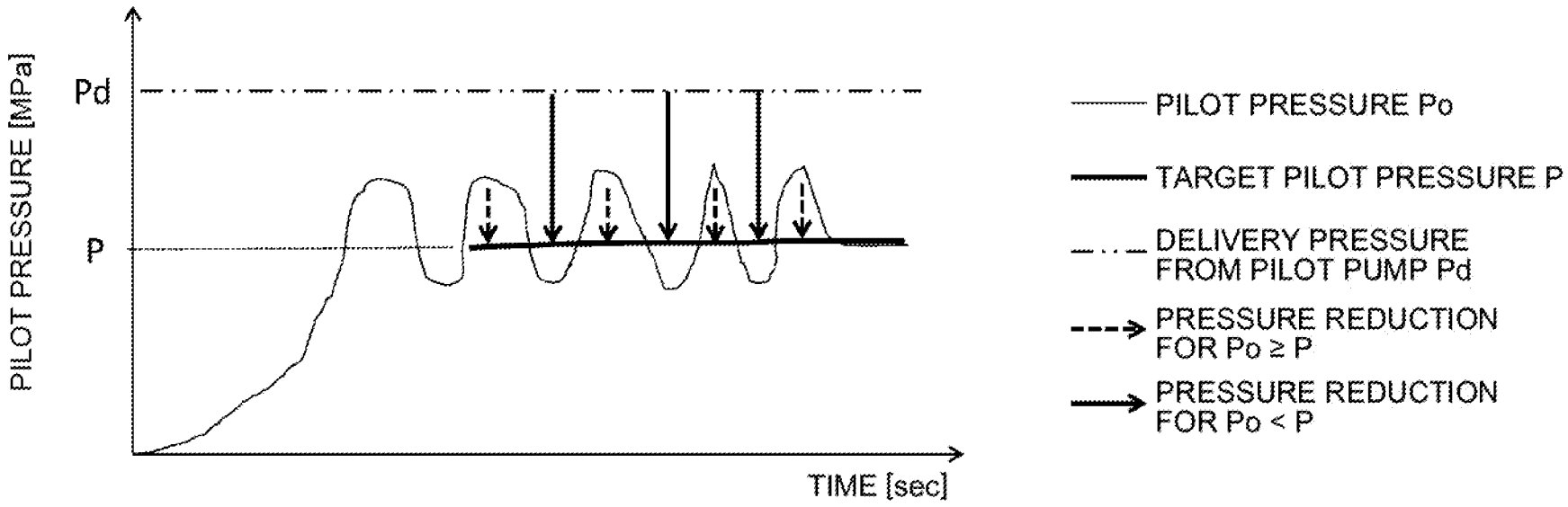
FIG. 3 is a graph which shows change in pilot pressure during traveling on a rough road and prescribed target pilot pressure.

FIG. 3 is a graph which shows change in pilot pressure during traveling on a rough road and prescribed target pilot pressure P set in the pilot pressure adjusting device 5L.

Since the hydraulic excavator 1 is often operated while traveling on a rough road, the vehicle body is likely to vibrate and the pilot pressure depending on the operation amount of the traveling operating lever 34L according to actual operation by the operator, namely pilot pressure Po detected by the pilot pressure sensor 56La (hereinafter simply called "pilot pressure Po") has a vibration cycle as indicated by the solid line in FIG. 3. In synchronization with this vibration cycle, the operator may erroneously operate the traveling operating lever 34L unintentionally and according to the operation amount with erroneous operation of the traveling operating lever 34L, the pilot pressure Po may vary largely.

If the largely varying pilot pressure Po is directly applied to the directional control valve 53L, jerking of the vehicle body would occur or jerking would be amplified. Therefore, the above pilot pressure adjusting device 5L reduces the varying pilot pressure Po to preset prescribed target pilot pressure P (hereinafter, simply called "target pilot pressure P") and applies it as an operation signal to the directional control valve 53L.

Specifically, in a case where pilot pressure Po is equal to or more than target pilot pressure P (Po≥P), pilot pressure Po is reduced to target pilot pressure P as indicated by the broken line down arrow in FIG. 3. At this time, the first solenoid pressure reducing valve 610La which has received a drive signal sent from the traveling controller 50 reduces pilot pressure Po to target pilot pressure P.

In a case where pilot pressure Po is lower than target pilot pressure P (Po<P), delivery pressure Pd from the pilot pump 54 (indicated by the chain double-dashed line in FIG. 3) is reduced to target pilot pressure P as indicated by the solid line down arrow in FIG. 3. At this time, the solenoid on-off valve 621La which has received a drive signal sent from the traveling controller 50 makes the bypass line 62La open and the second solenoid pressure reducing valve 622La which has received a drive signal reduces delivery pressure Pd from the pilot pump 54 to target pilot pressure P.

In other words, in this embodiment, in a case where pilot pressure Po is lower than target pilot pressure P (Po<P), delivery pressure Pd from the pilot pump 54, which is higher than pilot pressure Po, is reduced to target pilot pressure P, instead of increasing pilot pressure Po to target pilot pressure P.

Since target pilot pressure P which does not vary can be applied to the directional control valve 53L in this way, even in a case where pilot pressure Po generated by the hydraulic pilot valve 55La largely varies with erroneous operation of the traveling operating lever 34L, occurrence of jerking of the vehicle body can be prevented and amplification of jerking can be suppressed. Next, the detailed function of the traveling controller 50 in the pilot pressure adjusting device 5L will be described.

<Functional Structure of the Traveling Controller 50>

Next, the functional structure of the traveling controller 50 will be described referring to FIG. 4.

Figure 4:
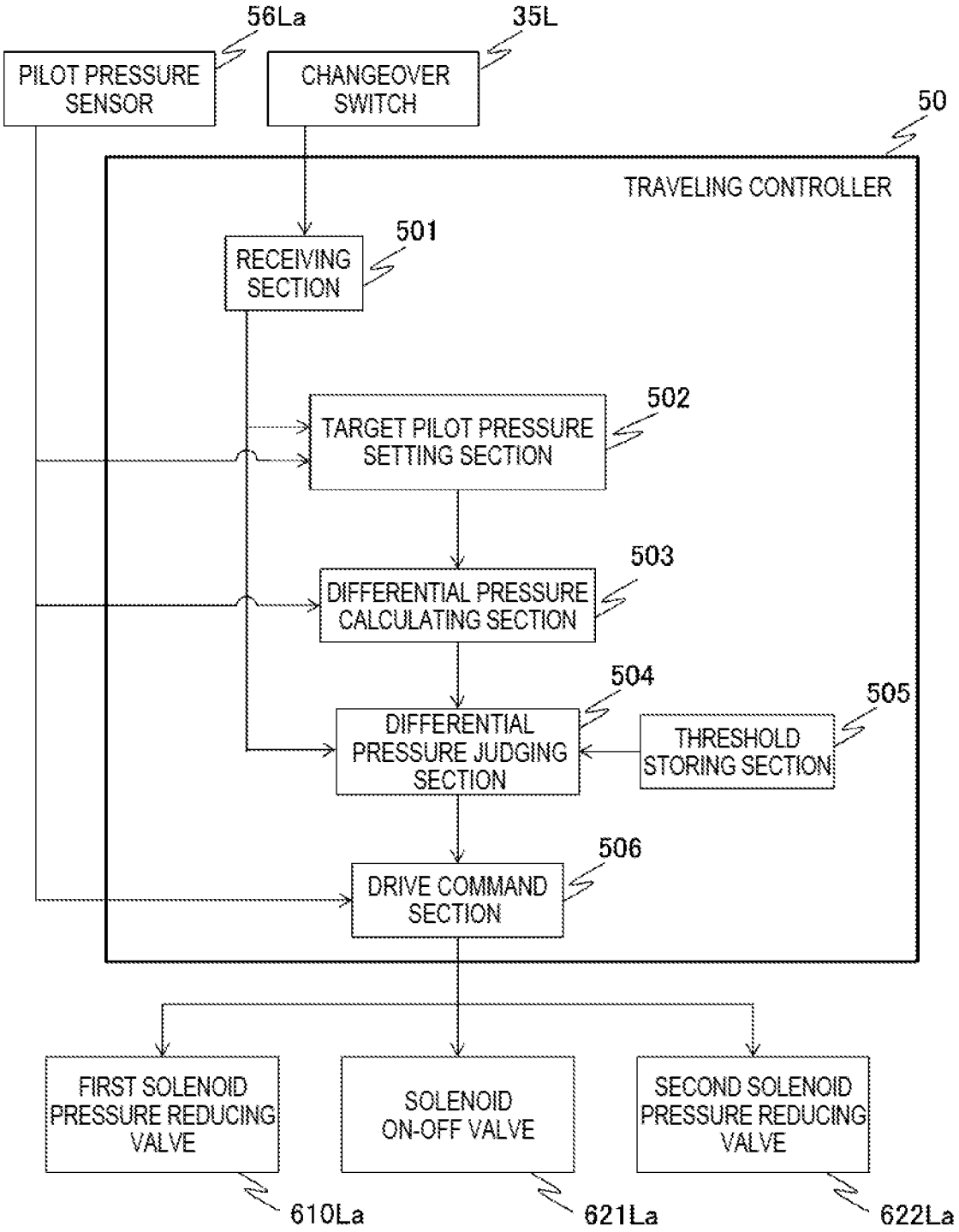
FIG. 4 is a functional block diagram which shows the function of a traveling controller.

FIG. 4 is a functional block diagram which shows the function of the traveling controller 50.

The traveling controller 50 includes a receiving section 501, target pilot pressure setting section 502, differential pressure calculating section 503, differential pressure judging section 504, threshold storing section 505, and drive command section 506.

The receiving section 501 receives a signal from the changeover switch 35L. In this embodiment, while the receiving section 501 is receiving a signal from the changeover switch 35L continuously, the operating mode of the traveling operating lever 34L remains the "control mode" and when the receiving section 501 no longer receives a signal from the changeover switch 35L, the operating mode of the traveling operating lever 34L is changed from the "control mode" to the "normal mode".

Based on information from the receiving section 501 and a signal from the pilot pressure sensor 56La, the target pilot pressure setting section 502 sets the pilot pressure (pilot pressure Po) detected by the pilot pressure sensor 56La at the time when the operating mode of the traveling operating lever 34L is changed to the "control mode", as target pilot pressure P.

Based on information from the target pilot pressure setting section 502 and a signal from the pilot pressure sensor 56La, the differential pressure calculating section 503 calculates the differential pressure between pilot pressure Po and target pilot pressure P (hereinafter simply called "differential pressure").

Based on information from the differential pressure calculating section 503 and threshold storing section 505, the differential pressure judging section 504 compares the differential pressure and threshold in terms of magnitude and judges the relation in magnitude of the differential pressure against the threshold. The threshold storing section 505 stores prescribed first threshold $\alpha$ and prescribed second threshold $\beta$ in advance.

Based on information from the differential pressure judging section 504 and a signal from the pilot pressure sensor 56La, the drive command section 506 sends a drive signal to each of the first solenoid pressure reducing valve 610La, solenoid on-off valve 621La, and second solenoid pressure reducing valve 622La so that pilot pressure Po reaches the prescribed pilot pressure (pilot pressure Po or target pilot pressure P).

Specifically, in the process of applying pilot pressure Po to the directional control valve 53L directly, the drive command section 506 sends a drive signal to the first solenoid pressure reducing valve 610La to reach pilot pressure Po. In the process of adjusting pilot pressure Po to target pilot pressure P and applying it to the directional control valve 53L, in a case where pilot pressure Po is equal to or more than target pilot pressure P (Po≥P), the drive command section 506 sends a drive signal to the first solenoid pressure reducing valve 610La to reach target pilot pressure P and in a case where pilot pressure Po is lower than target pilot pressure P (Po<P), it sends a drive signal to the solenoid on-off valve 621La to make the valve "open" and also sends a drive signal to the second solenoid pressure reducing valve 622La to reach target pilot pressure P.

<Processing in the Traveling Controller 50>

Next, concrete processing which is performed in the traveling controller 50 will be described referring to FIGS. 5 to 9.

Figure 5:
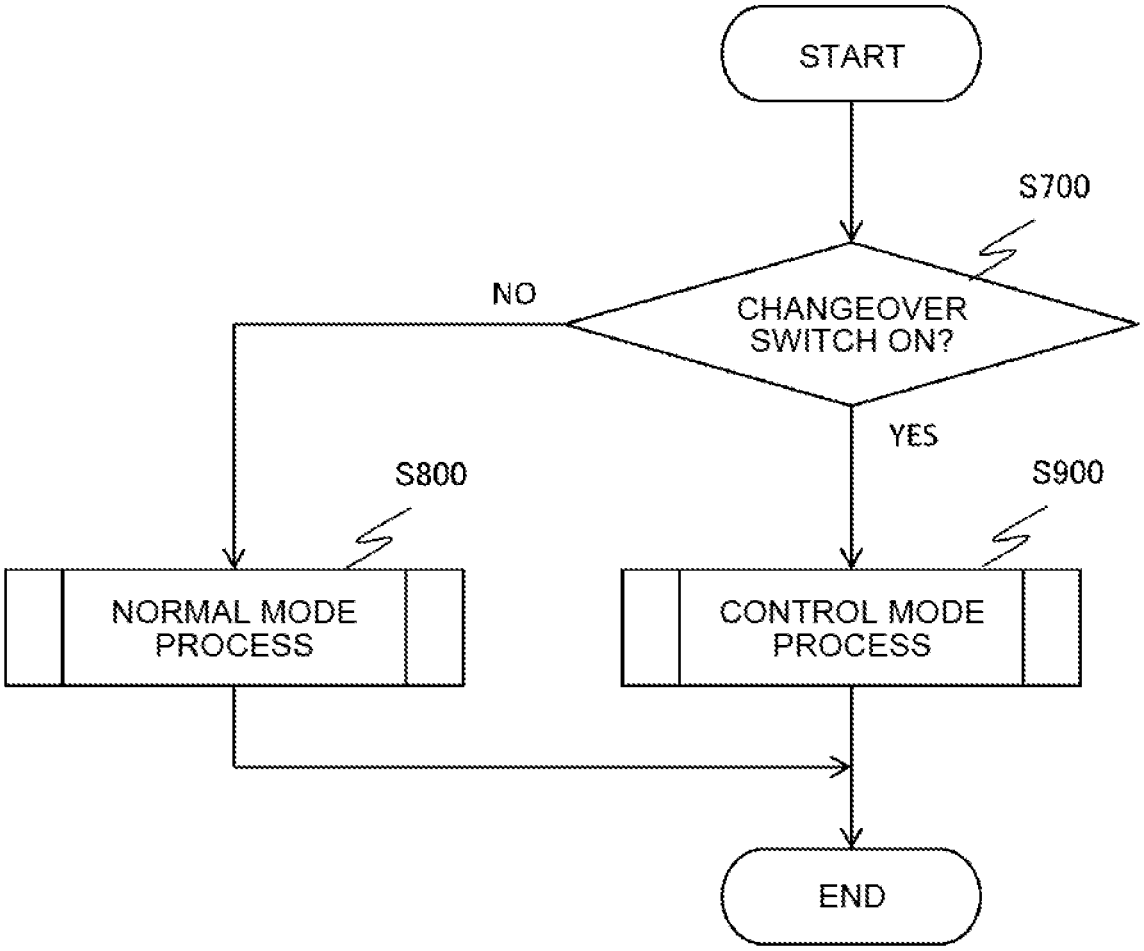
FIG. 5 is a flowchart which shows an outline of the processing sequence to be performed in the traveling controller.
Figure 6:
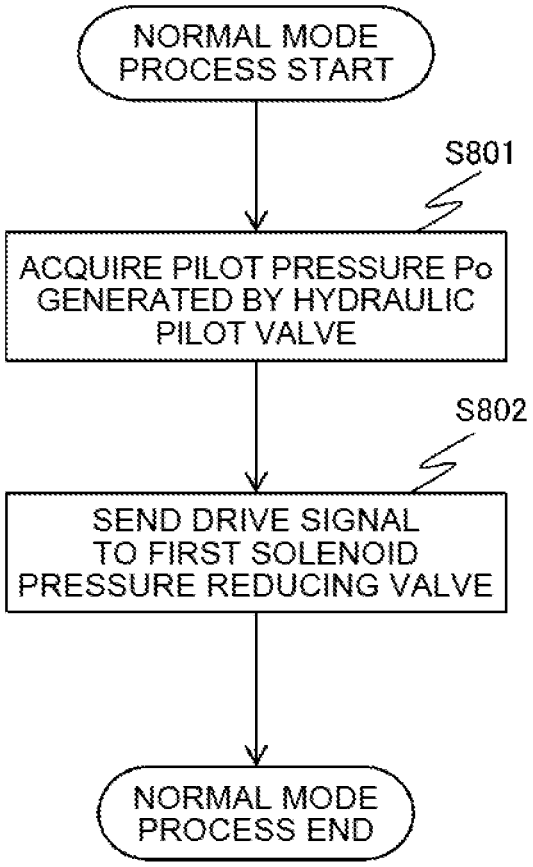
FIG. 6 is a flowchart which shows the sequence of the normal mode process to be performed in the traveling controller.
Figure 7:
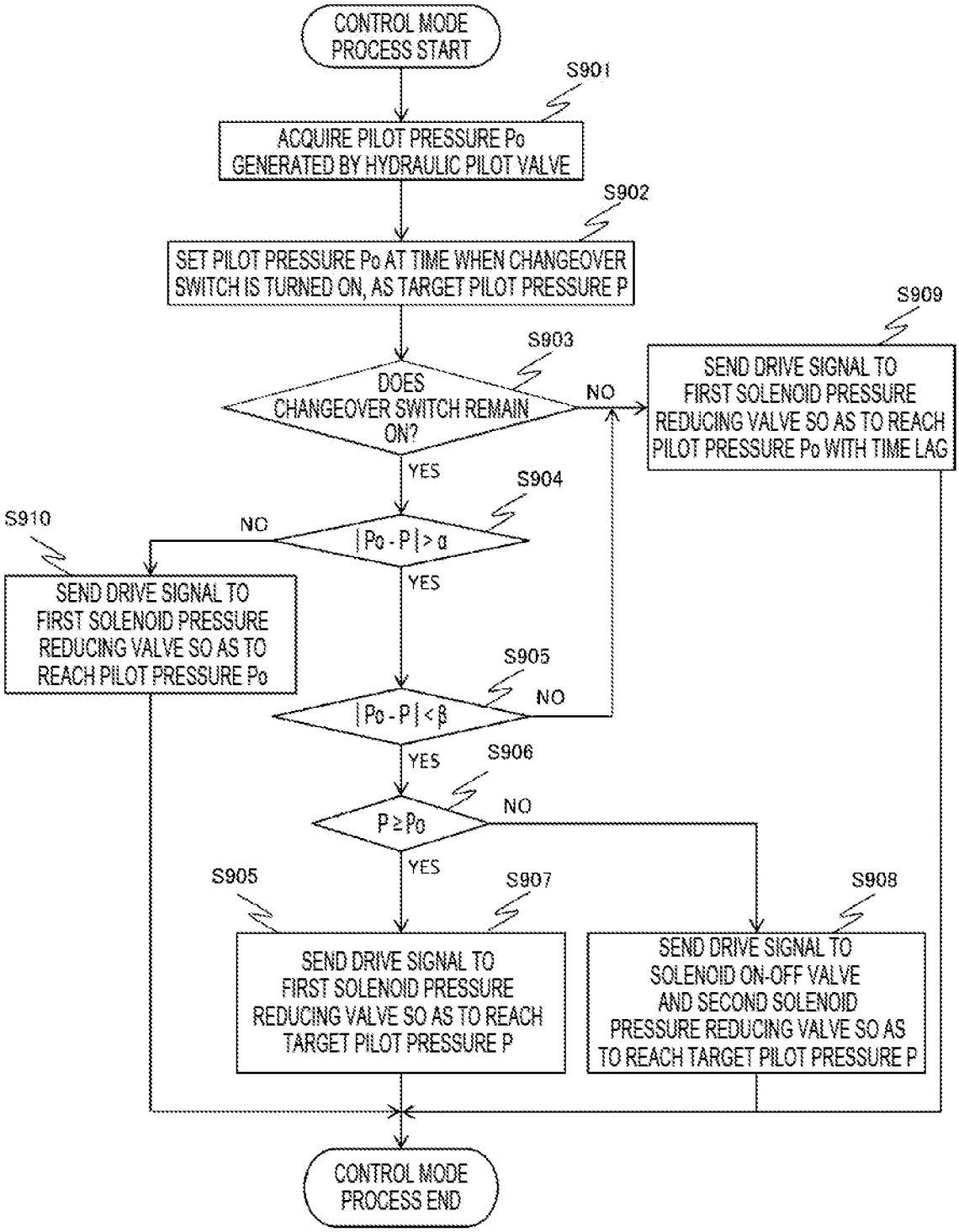
FIG. 7 is a flowchart which shows the sequence of the control mode process to be performed in the traveling controller.
Figure 8:
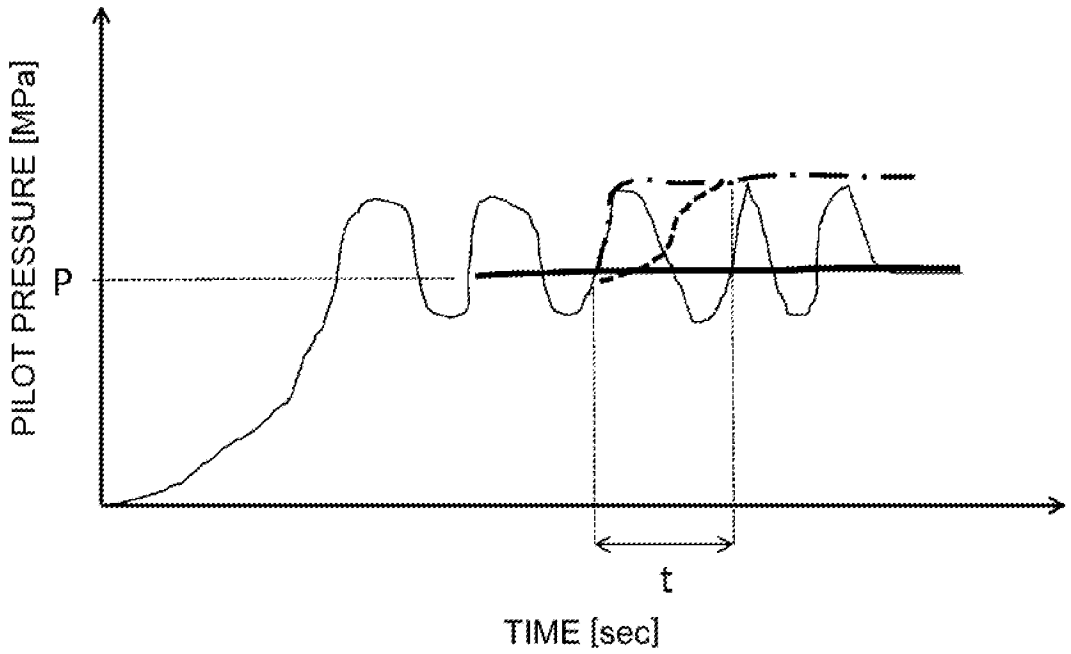
FIG. 8 is a graph which explains how the pilot pressure changes in a case where a lag process is performed.
Figure 9:
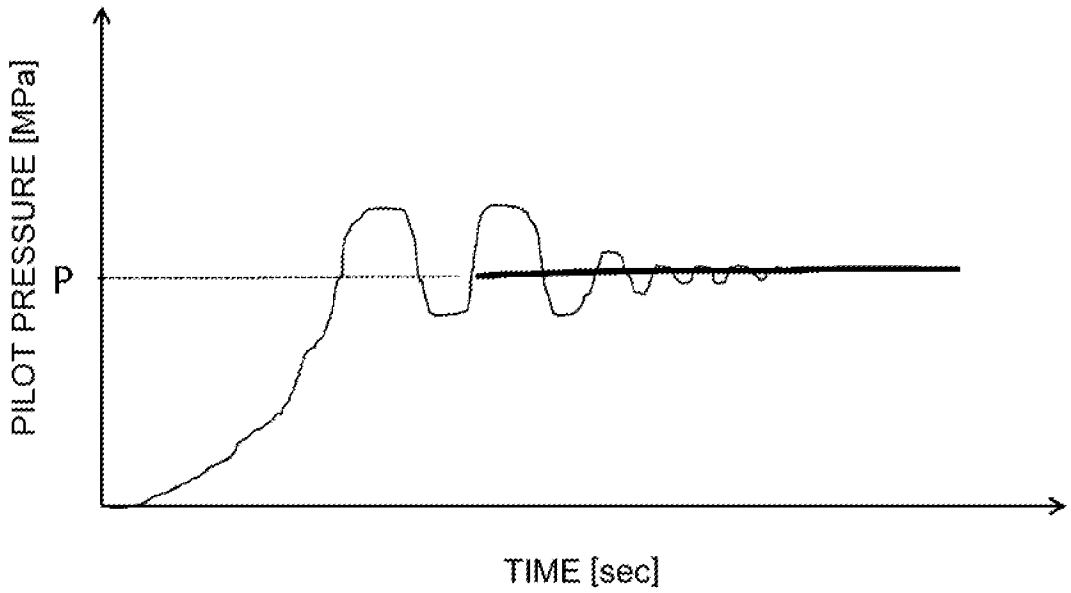
FIG. 9 is a graph which explains how the pilot pressure is in a case where the differential pressure between pilot pressure and prescribed target pilot pressure is equal to or less than a prescribed first threshold.

FIG. 5 is a flowchart which shows an outline of the processing sequence to be performed in the traveling controller 50. FIG. 6 is a flowchart which shows the sequence of the normal mode process to be performed in the traveling controller 50. FIG. 7 is a flowchart which shows the sequence of the control mode process to be performed in the traveling controller 50. FIG. 8 is a graph which explains how the pilot pressure changes in a case where a lag process is performed. FIG. 9 is a graph which explains how the pilot pressure is in a case where the differential pressure between pilot pressure Po and target pilot pressure P is equal to or less than the prescribed first threshold α.

First, as shown in FIG. 5, the receiving section 501 monitors signals from the pilot pressure sensor 56La and decides whether or not a signal has been received from the changeover switch 35L during traveling of the hydraulic excavator 1, namely whether or not the changeover switch 35L has been depressed (Step S700).

At Step S700, in a case where the receiving section 501 has not received a signal from the changeover switch 35L (Step S700/NO), the sequence goes to the "normal mode process" (Step S800) and the process is ended. This is a case when the hydraulic excavator 1 is in normal operation or suppression of jerking is unnecessary.

At Step S700, in a case where the receiving section 501 has received a signal from the changeover switch 35L (Step S700/YES), the sequence goes to the "control mode process" (Step S900) and the process is ended.

First, a case where the sequence goes to the normal mode process (Step S800) is explained. As shown in FIG. 6, the traveling controller 50 acquires pilot pressure Po (pilot pressure generated by the hydraulic pilot valve 55La depending on the operation amount of the traveling operating lever 34L) from the pilot pressure sensor 56La (Step S801).

Then, the drive command section 506 sends a drive signal to the first solenoid pressure reducing valve 610La so as to reach pilot pressure Po (apply pilot pressure Po directly) (Step S803) and the process is ended.

Next, a case where the sequence goes to the control mode process (Step S900) is explained. As shown in FIG. 7, the target pilot pressure setting section 502 acquires pilot pressure Po (pilot pressure generated by the hydraulic pilot valve 55La depending on the operation amount of the traveling operating lever 34L) from the pilot pressure sensor 56La (Step S901) and sets pilot pressure Po at the time when the changeover switch 35L is depressed, namely when the operating mode of the traveling operating lever 34L is changed to the "control mode", as target pilot pressure P (Step S902).

Then, the receiving section 501 decides whether or not a signal is continuously being received from the changeover switch 35L, namely whether or not the operating mode of the traveling operating lever 34L remains the "control mode" (Step S903).

In a case where at Step S903 the receiving section 501 is receiving a signal from the changeover switch 35L continuously (Step S903/YES), the differential pressure judging section 504 makes a comparison to decide whether or not the differential pressure (|Po−P|) calculated by the differential pressure calculating section 503 is larger than the prescribed first threshold α (α>0) (Step S904). Here, the prescribed first threshold α is a value relatively near 0 MPa, for example, 0.2 MPa. The case where at Step S903 the receiving section 501 is not receiving a signal from the changeover switch 35L continuously (Step S903/NO) will be described later.

In a case where at Step S904 it is decided that the differential pressure is larger than the prescribed first threshold α (|Po−P|>α), then the differential pressure judging section 504 makes a comparison to decide whether or not the differential pressure calculated by the differential pressure calculating section 503 is smaller than the prescribed second threshold β (Step S905). Here, the prescribed second threshold β is, for example, 1 MPa or a value larger than the prescribed first threshold α.

In this embodiment, the sequence goes to Step S905 after Step S904, but this order of steps is not a requisite; instead, the sequence may go to Step S904 after Step S905, or only one of Step S904 and Step S905 may be carried out.

In a case where at Step S904 the differential pressure is judged as equal to or less than the prescribed first threshold α (|Po−P|≤α), the drive command section 506 sends a drive signal to the first solenoid pressure reducing valve 610La so as to reach pilot pressure Po (apply pilot pressure Po directly) (Step S910) and the process is ended.

Here, the case where the differential pressure is equal to or less than the prescribed first threshold α (|Po−P|≤α) is a state in which suppression of jerking is not particularly necessary because pilot pressure Po is approximate to target pilot pressure P. In this case, by performing the process to apply pilot pressure (pilot pressure Po) depending on the operation amount of the traveling operating lever 34L to the directional control valve 53L, for example, even in a case where the operator forgets to release the changeover switch 35L (the operator keeps depressing the changeover switch 35L unintentionally), operation can be performed as in normal operation.

In a case where at Step S905 the differential pressure is smaller than the second threshold β ((|Po−P|<β), the drive command section 506 makes a comparison to decide whether or not the pilot pressure Po acquired at Step S901 is larger than target pilot pressure P (Step S906). The case where at Step S905 the differential pressure is equal to or more than the prescribed second threshold β (|Po−P|≥β) will be described later.

In a case where at Step S906 pilot pressure Po is equal to or more than target pilot pressure P (Po≥P), the drive command section 506 sends a drive signal to the first solenoid pressure reducing valve 610La so as to reach target pilot pressure P (Step S907) and the process is ended. Consequently, the first solenoid pressure reducing valve 610La reduces the pressure of pressure oil (pilot pressure Po) flowing in the pilot line 61La to target pilot pressure P.

In a case where at Step S906 pilot pressure Po is smaller than target pilot pressure P (Po<P), the drive command section 506 sends a drive signal to the solenoid on-off valve 621La to make it "open" and also sends a drive signal to the second solenoid pressure reducing valve 622La so as to reach target pilot pressure P (Step S908) and the process is ended. Consequently, the solenoid on-off valve 621La makes the bypass line 62La open and the second solenoid pressure reducing valve 622La reduces the pressure of pressure oil from the pilot pump 54 (delivery pressure Pd) flowing in the bypass line 62La to target pilot pressure P.

Next, in a case where at Step S903 the receiving section 501 is not receiving a signal from the changeover switch 35L continuously and in a case where at Step S905 the differential pressure is equal to or more than the prescribed second threshold $\beta(|Po-P|\geq\beta)$, how the process goes will be described.

In these cases, as shown in FIG. 7, the drive command section 506 sends a drive signal with a time lag element added to the first solenoid pressure reducing valve 610La so as to reach pilot pressure (pilot pressure Po) depending on the operation amount of the traveling operating lever 34L with a time lag (t[sec] shown in FIG. 8) (Step S909) and the process is ended.

Here, in a case where the drive command section 506 sends a drive signal simply without a time lag to the first solenoid pressure reducing valve 610La, as indicated by the dashed-dotted line in FIG. 8 the pilot pressure applied to the directional control valve 53L might suddenly change and cause the vehicle body to vibrate largely.

Therefore, as indicated by the broken line in FIG. 8, the drive command section 506 sends a drive signal with a time lag element added to the first solenoid pressure reducing valve 610La, which adjusts the opening of the first solenoid pressure reducing valve 610La gradually and thus suppresses the sudden change in the pilot pressure applied to the directional control valve 53L so that the hydraulic excavator 1 can travel smoothly. In the graph shown in FIG. 8, a first-order lag element is used for the time lag element, but the time lag element need not be always a first-order lag element.

In a case where at Step S903 the receiving section 501 is not receiving a signal from the changeover switch 35L continuously (Step S903/No), it is a case that the operating mode of the traveling operating lever 34L has been changed from the "control mode" to the "normal mode" (state in which the operator has released his/her finger from the changeover switch 35L) and thus the process corresponds to a process of changing the mode from the control mode process to the normal mode process.

Also, in a case where at Step S905 the differential pressure is equal to or more than the prescribed second threshold $\beta$, $(|Po-P|\geq\beta)$, it is a state in which the operator has kept depressing the changeover switch 35L (for example, the operator forgets to release the changeover switch 35L), but it may be a case that the hydraulic excavator 1 is expected to travel according to operation of the traveling operating lever 34L by the operator, such as a case where the pilot pressure applied to the directional control valve 53L is expected to be changed intentionally.

As explained above, according to a drive signal sent from the traveling controller 50, a varying pilot pressure is controlled to a non-varying pilot pressure (target pilot pressure P) before being applied to the directional control valve 53L and, for example, when the hydraulic excavator 1 is expected to travel according to actual operation of the traveling operating lever 34L by the operator, the control over the pilot pressure is gradually released, thereby preventing occurrence of unwanted jerking of the vehicle body or suppressing amplification of jerking so that the operability for the operator can be improved.

So far the embodiment of the present invention has been described. The present invention is not limited to the above embodiment but includes many variations. For example, the above embodiment has been described in detail for easy understanding of the present invention; however the present invention is not limited to a structure which includes all the elements described above. An element of the above embodiment may be replaced by an element of another embodiment and an element of another embodiment may be added to the above embodiment. Furthermore, addition of another element, deletion, or replacement can be made for an element of the above embodiment.

For example, in the above embodiment, the traveling operating levers 34L and 34R have been described as operating devices but an operating device need not be a lever which the operator manipulates by hand; for example, it may be a traveling operation pedal.

In the above embodiment, the changeover switches 35L and 35R as changeover devices are switches which the operator must keep depressing to hold the "control mode" state; however, the specification of the changeover device is not limited.

In the above embodiment, the traveling controller 50 includes the receiving section 501, and ON or OFF information of the changeover switch 35L is based on information from the receiving section 501, but it need not be always based on information from the receiving section 501. For example, a signal may be sent directly from the changeover switch 35L or 35R to various sections of the traveling controller 50.

In the above embodiment, as hydraulic actuators, the travel motors 22L and 22R have been described, but instead, the hydraulic actuators may be other hydraulic actuators such as the boom cylinder 40*a*, arm cylinder 40*b*, and bucket cylinder 40*c*.

In the above embodiment, as a construction machine, the crawler type hydraulic excavator 1 has been described, but it need not be a crawler type construction machine. For example, it may be a wheel type construction machine such as a wheel type hydraulic excavator.

In addition, the control mode process (Step S900) should be at least a process to set the pilot pressure Po detected by the pilot pressure sensor 56La at the time when the operating mode of the traveling operating lever 34L is changed to the control mode by the changeover switch 35L, as target pilot pressure P and send a drive signal to enable the pilot pressure applied to the directional control valve 53L to reach target pilot pressure P.

REFERENCE SIGNS LIST 5L, 5R . . . pilot pressure adjusting device,
22L, 22R . . . travel motor (hydraulic actuator),
34L, 34R . . . traveling operating lever (operating device),
35L, 35R . . . changeover switch (changeover device),
50 . . . traveling controller (controller),
51L, 51R . . . hydraulic pump,
53L, 53R . . . directional control valve,
54 . . . pilot pump,
55La, 55Lb, 55Ra, 55Rb . . . hydraulic pilot valve,
56La, 56Lb, 56Ra, 56Rb . . . pilot pressure sensor,

61La, 61Lb, 61Ra, 61Rb . . . pilot line,
62La, 62Lb, 62Ra, 62Rb . . . bypass line,
501 . . . target pilot pressure setting section,
506 . . . drive command section,
610La, 610Lb, 610Ra, 610Rb . . . first solenoid pressure reducing valve,
621La, 621Lb, 621Ra, 621Rb . . . solenoid on-off valve,
622La, 622Lb, 622Ra, 622Rb . . . second solenoid reducing valve,
P . . . prescribed target pilot pressure,
α . . . prescribed first threshold,
β . . . prescribed second threshold

The invention claimed is:

1. A construction machine comprising a hydraulic pump, a hydraulic actuator driven by pressure oil supplied from the hydraulic pump, an operating device to operate the hydraulic actuator, a pilot pump, a hydraulic pilot valve to generate a pilot pressure as an oil pressure signal depending on operation amount of the operating device from the pressure oil supplied from the pilot pump, and a directional control valve driven by the pilot pressure from the hydraulic pilot valve to control a flow of the pressure oil supplied to the hydraulic actuator, wherein the construction machine includes:

a changeover device which changes an operating mode of the operating device to a normal mode or a control mode selectively;

a pilot pressure adjusting device which adjusts the pilot pressure applied to the directional control valve; and a pilot pressure sensor which detects the pilot pressure, the pilot pressure adjusting device includes:

a pilot line which connects the hydraulic pilot valve and the directional control valve and includes a first solenoid pressure reducing valve;

a bypass line which connects the pilot pump and the directional control valve by bypassing the hydraulic pilot valve and includes an solenoid on-off valve and a second solenoid pressure reducing valve; and a controller which receives a signal from the changeover device and the pilot pressure sensor and sends a drive signal to each of the first solenoid pressure reducing valve, the solenoid on-off valve, and the second solenoid pressure reducing valve, the controller includes:

a target pilot pressure setting section which sets a prescribed target pilot pressure based on the signal from the changeover device and the pilot pressure sensor; and a drive command section which sends the drive signal based on the signal from the pilot pressure sensor and information from the target pilot pressure setting section, in case that the operating mode of the operating device is changed to the control mode by operation of the changeover switch, the target pilot pressure setting section sets the pilot pressure detected by the pilot pressure sensor at time of change to the control mode, as the prescribed target pilot pressure, and in case that the pilot pressure detected by the pilot pressure sensor is higher than the prescribed target pilot pressure, the drive command section sends the drive signal to the first solenoid pressure reducing valve so as to reach the prescribed target pilot pressure, and on the other hand, in case that the pilot pressure detected by the pilot pressure sensor is lower than the prescribed target pilot pressure, the drive command section sends the drive signal to each of the solenoid on-off valve and the second solenoid pressure reducing valve so as to reach the prescribed target pilot pressure.

2. The construction machine according to claim 1, wherein in a case where differential pressure between the pilot pressure detected by the pilot pressure sensor and the prescribed target pilot pressure is equal to or less than a prescribed first threshold, the drive command section sends the drive signal to the first solenoid pressure reducing valve so as to reach the pilot pressure depending on the operation amount of the operating device.

3. The construction machine according to claim 1, wherein in a case where the operating mode of the operating device is changed from the control mode to the normal mode, the drive command section sends the drive signal with a time lag element added to the first solenoid pressure reducing valve so as to reach the pilot pressure depending on the operation amount of the operating device with a time lag.

4. The construction machine according to claim 1, wherein in a case where differential pressure between the pilot pressure detected by the pilot pressure sensor and the prescribed target pilot pressure is equal to or more than a prescribed second threshold, the drive command section sends the drive signal with a time lag element added to the first solenoid pressure reducing valve so as to reach the pilot pressure depending on the operation amount of the operating device with a time lag.

* * * * *